US007849912B2

(12) United States Patent
Holzgruber et al.

(10) Patent No.: US 7,849,912 B2
(45) Date of Patent: Dec. 14, 2010

(54) PROCESS FOR ELECTROSLAG REMELTING OF METALS AND INGOT MOULD THEREFOR

(75) Inventors: Wolfgang Holzgruber, Bruck a.d. Mur (AT); Harald Holzgruber, Bruck a.d. Mur (AT)

(73) Assignee: Inteco Special Melting Technologies GmbH, Bruck/Mur (AT)

( * ) Notice: Subject to any disclaimer, the term of this patent is extended or adjusted under 35 U.S.C. 154(b) by 370 days.

(21) Appl. No.: 11/939,569

(22) Filed: Nov. 14, 2007

(65) Prior Publication Data

US 2008/0115909 A1 May 22, 2008

(30) Foreign Application Priority Data

Nov. 15, 2006 (AT) ..... A 1884/2006
Dec. 28, 2006 (DE) ..... 10 2006 062 460

(51) Int. Cl.
*B22D 11/00* (2006.01)
*B22D 27/02* (2006.01)

(52) U.S. Cl. ..... 164/470; 164/497; 164/509

(58) Field of Classification Search ..... 164/470, 164/497, 509, 515
See application file for complete search history.

(56) References Cited

U.S. PATENT DOCUMENTS 4,000,361 A 12/1976 Bondarenko et al.
6,758,259 B1 * 7/2004 Holzgruber et al. ..... 164/470
6,853,672 B2 * 2/2005 Holzgruber et al. ..... 373/42
6,913,066 B2 * 7/2005 Holzgruber et al. ..... 164/470

FOREIGN PATENT DOCUMENTS

| | | |
|---|---|---|
| AT | 287215 | 1/1971 |
| AT | 297959 | 4/1972 |
| AT | 406239 B | 3/2000 |
| AT | 410413 | 4/2003 |
| DE | 19614182 C1 | 7/1997 |
| WO | 02/40726 A1 | 5/2002 |

OTHER PUBLICATIONS

Austrian Search Report for AT A 1884/2006, dated Apr. 24, 2007.

* cited by examiner

*Primary Examiner*—Kuang Lin
(74) *Attorney, Agent, or Firm*—Bachman & LaPointe, P.C.

(57) ABSTRACT

The energy consumption during electroslag remelting is determined to a considerable extent by the heat losses of a slag bath on the wall of a water-cooled ingot mould. A process and an ingot mould suitable for carrying it out wherein these heat losses may be avoided for the most part. Remelting thus takes place in a short, two-part sliding ingot mould known per se, except in the start-up phase, during normal block construction, the metal surface is always kept in the lower, water-cooled part of the ingot mould- that is below the line of separation between water-cooled part and insulated part of the same—by corresponding control of the relative movement between ingot mould and remelting block, so that the distance between the surface area of the metal surface on the one hand and the planes determined by the line of separation between cooled part and insulated part on the other hand, is at least 5 mm, but 100 mm at the most.

5 Claims, 1 Drawing Sheet

PROCESS FOR ELECTROSLAG REMELTING OF METALS AND INGOT MOULD THEREFOR

BACKGROUND OF THE INVENTION

The invention relates to a process for electroslag remelting of metals, in particular of iron-based and nickel-based alloys, for producing remelting blocks from one or more consumable electrodes in a short, water-cooled sliding ingot mould according to the preamble of patent claim 1. In addition, the invention includes an ingot mould which is improved with respect to the state of the art for carrying out this process.

In electroslag remelting plants operating today, water-cooled ingot moulds are used for shaping and producing the remelting blocks, their casting mould wall shaping the block and holding the slag bath generally consisting of copper, since this material, as also known from continuous casting, is most suitable to remove the quantities of heat being released on solidification of metals rapidly and efficiently into the cooling water. Whereas in continuous casting, only short ingot moulds are used, from which the solidifying bar is withdrawn more or less continuously after forming a first supportable bar shell, in electroslag remelting according to the state of the art, both the use of so-called fixed ingot moulds and the use of short sliding ingot moulds is conventional.

In fixed ingot moulds, the length of the ingot mould corresponds to the length of the block to be produced. The ingot mould is filled here successively with remelted metal in the course of the remelting process by melting out the self-consuming electrode in the slag bath floating on the metal surface, wherein there is no relative movement between ingot mould—or ingot mould wall—and remelting block.

When using sliding ingot moulds, remelting blocks are produced, the length of which exceeds the length of the ingot mould by a multiple. The short, water-cooled ingot mould serves here as a melt and casting mould, in which the hot slag bath is situated and in which the metal melting out from the electrode is collected and solidified subsequently to form the remelting block. The ingot mould is therefore required for carrying out the remelting process only in the region of the slag bath and in the region of block solidification. If the remelting block is solidified one time, the casting mould fulfils no further purpose. It is thus possible to restrict the length of the ingot mould to this range described above and to withdraw the block being formed during the melting out process, for example from the ingot mould at an average rate which corresponds to the rate of block construction. This leads to a relative movement between the block formed and the ingot mould wall and results in the meniscus of the metal surface and the slag bath resting thereon—except in the start-up phase—remaining essentially at a constant level within the ingot mould during the entire block construction. Instead, as described above, of withdrawing the block being formed from an ingot mould installed in a working platform, it is also possible to construct the remelting block on a fixed base plate and to withdraw upwards the short ingot mould by means of a suitable device at a rate corresponding to the rate of block construction.

As generally known, the consumption of electrical melting energy during electroslag remelting is relatively high compared to other melting processes likewise operating using electrical energy, such as for example during scrap-metal melting in an electric-arc furnace or a crucible induction furnace, since during electroslag remelting, the melting out rate is controlled primarily in order to ensure fault-free solidification structure of the remelting blocks. An energy saving by increasing the melting-out rate is therefore not possible, wherein direct contact of the slag bath heated to high temperature by the passage of current and serving as a heat source with the water-cooled ingot mould wall still has a considerable additional negative influence.

In order to melt iron-based or nickel-based alloys from ambient temperature and to heat them at about 1,600° C., a theoretical energy requirement of about 400 kWh/t is necessary. If the melting and superheating takes place in an electric-arc furnace or induction furnace using only electrical energy, an energy consumption of 500 to 700 kWh/t can be expected due to the process-related heat losses. In contrast thereto, the energy consumption in the production of a remelting block having, for example 1,000 mm diameter for a remelting rate of 1,000 kg/h depending on the slag used and the level of the slag bath, is between 1,000 and 1,800 kWh/t. This can be attributed to the fact that the heat flow from the hot slag via the water-cooled ingot mould wall into the cooling water, depending on slag composition, is between 1,000 and 2,000 $kW/m^2$. For the most frequently used slags having in each case ⅓ CaO, $CaF_2$ and $Al_2O_3$, about 1,100 $kW/m^2$ must be expected. For remelting in an ingot mould having 1,000 mm diameter and a slag bath level of about 200 mm, an energy loss in the slag zone of about 630 kW must thus be expected, which for a remelting rate of 1,000 kg/h corresponds to an energy consumption of about 630 kWh/t. Relative to a total energy consumption during remelting with the slag indicated above of about 1,300 kWh/t, this corresponds to a percentage of just 50%. For slags having higher contents of $CaF_2$, this proportion may however become significantly higher still.

For the reasons outlined above, it would therefore be obvious to insulate the ingot mould against heat losses in the region of the slag bath in order to thus lower the melt energy consumption. According to the Austrian patent specification 287 215, it has already given a corresponding proposal in 1968, according to which during electroslag remelting, by controlling the position of the surface of the metal melt in the ingot mould, the entire slag floating on the metal melt is collected as a liquid slag layer in a heat-insulated zone of the ingot mould; the temperature of the liquid slag layer is thus kept above or at least at the melt temperature of the metal by the heat insulation. The liquid metal collected in the ingot mould therefore passes into the region of the heat insulation, and the line of separation between the insulated and the water-cooled ingot mould part is situated below the metal surface.

This arrangement corresponding to the current state of the art has the disadvantage that the start of solidification is not adequately defined and hence considerable difficulties may occur in operational use. Hence, it is possible that with corresponding superheating of the metal, the latter penetrates into the gap between insulated and water-cooled part of the ingot mould and solidifies there in contact with the water-cooled lower part and forms a metal tab which remains suspended in the gap. Depending on the thickness of the tab, the block may now remain suspended anyway in the ingot mould and block withdrawal may become impossible, as a result of which the remelting process would be stopped. If the tab is of lower thickness and is not formed over the entire block periphery, cracks will be formed in the solidifying shell, which make difficult at least further processing of the block. If deeper cracks are formed, there may be discharging of liquid metal and the slag, as a result of which the remelting process would be stopped again. These problems of transition from an insulated container to a water-cooled form of solidification in contact with liquid or in the end solidifying metal are known from horizontal continuous casting. There, the problem is solved in that a so-called breaking ring made from boron nitride, which prevents advance of solidification beyond the boundary line insulation-water-cooling and facilitates easy release of the solidified bar shell due to its specific properties with regard to heat conductivity, wettability by the liquid metal etc., is installed at the transition point insulation-water-cooling. However, boron nitride is an expensive material which is complex to produce and can be obtained only in relatively small dimensions up to conventional continuous casting dimensions in the range up to about 200 mm diameter and is thus not suitable for the dimensions of 500 mm diameter and considerably above that which are of interest for electroslag remelting. For all these reasons, the process outlined above corresponding to the state of the art has as yet not found a practical application in spite of the obvious economic advantages.

The object of the present invention is now to utilize on the one hand the economic advantage of thermal insulation in the region of the slag bath during electroslag remelting, while the problems described above, so that a technical application becomes possible in useful manner.

SUMMARY OF THE INVENTION

According to the invention, the solution to this object is achieved using a short, two-part sliding ingot mould known per se, its lower part shaping the casting cross-section being water-cooled in conventional manner and its upper part being insulated completely or partly against heat removal, in that except in the start-up phase during normal block construction, the metal surface is always kept in the lower, water-cooled part of the ingot mould—that is below the line of separation between water-cooled and insulated part of the same—by appropriate control of the relative movement between ingot mould and remelting block, so that the distance between the surface area of the metal surface on the one hand and the plane determined by the line of separation between cooled and insulated part on the other hand, is 5 mm, but 100 mm at the most, and in that the slag bath floating on the metal surface is situated at least to 75% of its height in the region of the insulated part.

The relative movement may thus be either step-wise or continuous in a manner known per se; for step-wise movement, the movement step followed by a rest should correspond at least to double the block construction rate. In principle, a step in the opposite direction, the step length of which accounts for maximum 30% of the length of the original movement step, may follow each such movement step. An oscillating movement may also be superimposed on a, where applicable, continuous withdrawal movement.

For the production of a layer hindering heat removal, a lining having a heat-insulating, preferably ceramic layer—for example porcelain—has been proposed in the said Austrian 287 215. The problem with this material, but also with other ceramic materials, consists in the fact that they are soluble in the superheated reactive slag and thus would be consumed by the latter within only a short time.

BRIEF DESCRIPTION OF THE DRAWINGS

Further advantages, features and details of the invention can be seen from the following description of a preferred exemplary embodiment and using the drawing; this shows in its single FIGURE, a schematic cross-section through a multi-parted ingot mould unit with an ingot mould which is improved with respect to the state of the art, and which is particularly suitable for carrying out the process of the invention.

DETAILED DESCRIPTION

Figure 1:
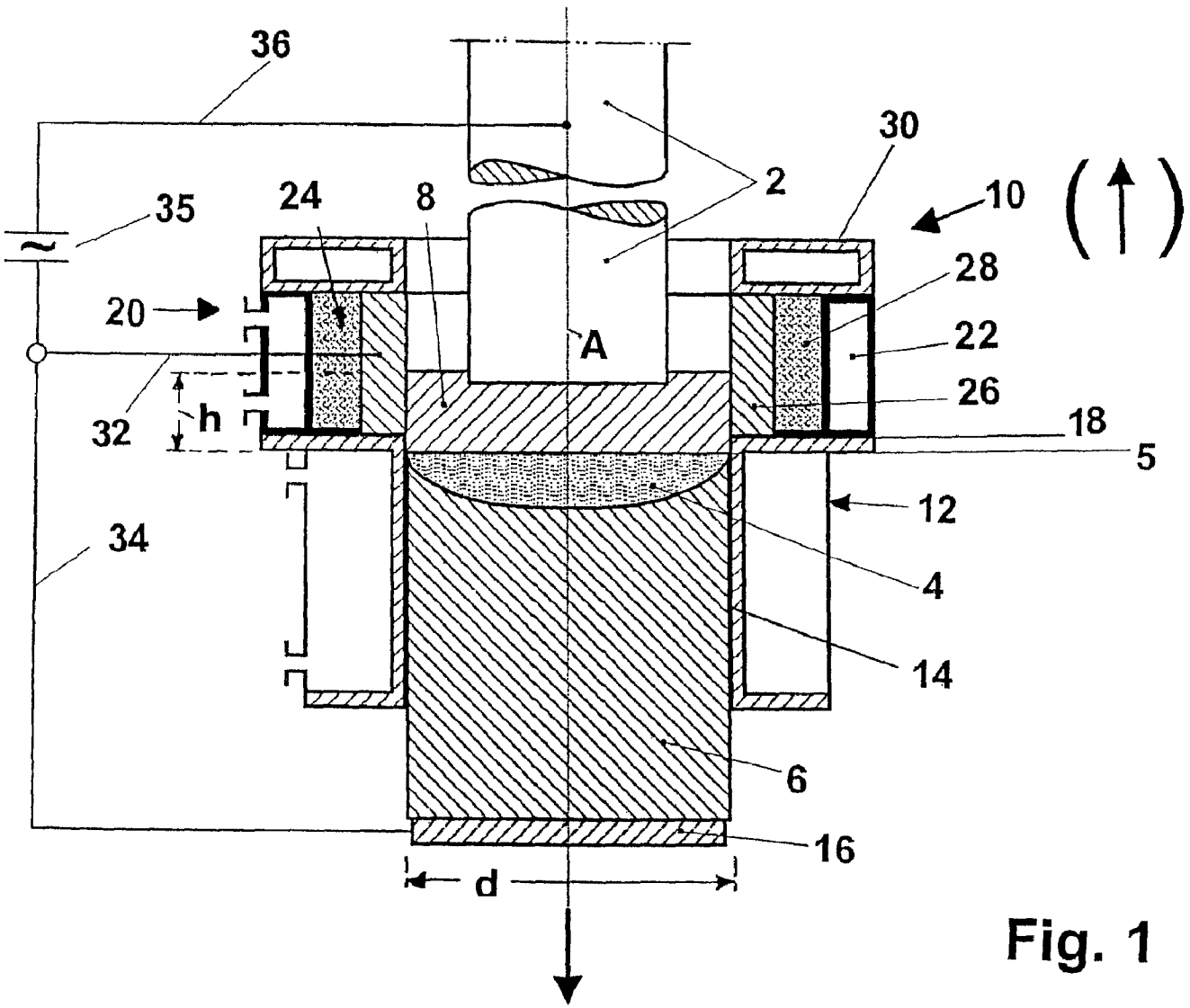

A lower base part of a sliding ingot mould as a multi-parted ingot mould unit 10 represents a water-cooled solidification or casting mould 12, the inner wall of which preferably consists of an insert 14 made from copper; the latter is installed in a water jacket or water box not shown separately in the drawing. In this insert 14, metal dropping from consumable electrodes 2 arranged thereabove in the ingot mould longitudinal axis A is collected in a metal sump 4 and solidifies to form a remelting block 6. The metal surface 5 of the metal sump 4 is superimposed by a slag bath 8.

The remelting block 6 is withdrawn from the casting mould 12 by a lowerable base plate 16 only indicated here, so that the metal surface 5 always remains below an upper, water-cooled flange surface 18 of the casting mould 12; above which is situated an upper ingot mould part 20, which is constructed to be multi-parted and comprises a water-cooled supporting construction 22 in the form of a tube ring of rectangular cross-section and a likewise annular insert 24. Its inner layer 26 consisting preferably of graphite or a high-melting metal—such as for example tungsten or molybdenum—is in contact with the slag bath 8 of height h. The inner layer 26 of rectangular radial section has an internal diameter which corresponds approximately to the internal diameter d of the casting mould 12.

An intermediate layer 28 likewise of rectangular radial section, which assumes the function of heat insulation, is arranged between the inner layer 26 and the supporting construction 22. This intermediate layer 28 preferably consists of a heat-insulating, refractory, ceramic material which is resistant to temperature change, for example of a high temperature-resistant ceramic fibrous mat, of light-weight refractory bricks or a further ceramic high temperature-resistant material, such as tamping materials or granulated metal.

In principle, the supporting construction 22 of the upper, heat-insulating ingot mould 20 may also be formed as an extension of the water jacket of the lower ingot mould part 12, in which the inner layer 26 and the intermediate layer 28 are then installed. Furthermore, the upper ingot mould part 20 consisting of the supporting construction 22, the inner layer 26 and the intermediate layer 28—if required—may be kept down by a likewise water-cooled cover ring 30, lying here in the form of a tube ring of rectangular radial section, for which purpose the cover ring 30 may be clamped together with the water jacket of the lower, water-cooled ingot mould part 12 by elements not shown here.

Instead of by block withdrawal from the ingot mould 12, the remelting block 6 may also be constructed on a fixed base plate. In this case, it is necessary to raise the ingot mould unit 10 according to the block construction rate—in analogous manner, as outlined above for block withdrawal—either step-wise or continuously, which is indicated in FIG. 1 by an upwardly directed arrow placed in brackets.

In a particular embodiment of the ingot mould unit 10—as shown here—the insert 24 of the upper ingot mould part 20 in contact with the slag bath 8 may be connected to a return lead 34 of the melt current for melt current supply 35 via a corresponding high-current lead 32, so that the insert 24 is at the same potential as the base plate 16.

However, the possibility also exists—not shown here—of connecting the insert 24 of the upper ingot mould part 20 to the high-current supply 36 to the consumable electrode 2, when an intermediate layer of, for example high-melting ceramic material not conducting the electrical current and likewise not shown here, is installed between the water-cooled lower ingot mould part 12 and at least the inner layer

26 and, if required, the supporting construction 22 of the upper ingot mould part 20. In this case, the inner layer 26 of the upper ingot mould part is at the potential of the consumable electrode 2.

The invention claimed is:

1. In a two-part sliding ingot mould having a water cooled lower part and an insulated upper part defining a line of separation therebetween, a process for the electroslag remelting of metals comprising the steps of:

maintaining the metal surface of the metal sump in the water cooled lower part of the mould below the line of separation by controlling relative movement between the two-part sliding ingot mould and a remelting block such that the distance between surface area of the metal surface and a plane determined by the line of separation is between 5 mm and 100 mm and a slag bath floating on the metal surface is situated at least to 75% of the height (h) of the insulated upper part.

2. A process according to claim 1, carrying out relative movement between ingot mould and remelting block in a step-wise manner, wherein the rate of movement corresponds at least to twice a block construction rate.

3. A process according to claim 1, carrying out relative movement between ingot mould and remelting block continuously.

4. A process according to claim 2, wherein for step-wise movement each relative movement step is followed by a step in opposite direction, the stroke length of which is maximum 30% of the stroke length of the relative movement step.

5. A process according to claim 3, wherein an oscillation is superimposed on the continuous relative movement between ingot mould and remelting block.

* * * * *